United States Patent [19]

Floc'h

[11] Patent Number: 5,012,215

[45] Date of Patent: Apr. 30, 1991

[54] PROTECTED SWITCH CONTACTOR APPARATUS

[75] Inventor: Noël Floc'h, Val De Reuil Le Vaudreuil, France

[73] Assignee: Telemecanique, France

[21] Appl. No.: 481,536

[22] Filed: Feb. 20, 1990

[30] Foreign Application Priority Data

Feb. 21, 1989 [FR] France ..... 89 02215

[51] Int. Cl.[5] ..... H01H 67/02

[52] U.S. Cl. ..... 335/132; 335/202

[58] Field of Search ..... 335/131, 132, 133, 202; 207/308

[56] References Cited

U.S. PATENT DOCUMENTS 4,254,316 3/1981 Landow ..... 335/132

4,309,683 1/1982 Grunert et al. ..... 335/132

4,719,542 1/1988 Lemmer ..... 335/132

*Primary Examiner*—Leo P. Picard

*Assistant Examiner*—Lincoln Donovan

*Attorney, Agent, or Firm*—William A. Drucker

[57] ABSTRACT

A protected switch contactor apparatus is disclosed comprising a plurality of parallel sections with respective switches actuated by a common rack. One of these switches consists of a sealed monostable micro-switch with high speed cut-off whose internal terminals are connected to external terminals disposed in two opposite housings of each section. The micro-switch is housed in an insulated cavity situated between the two housings and opening, on the side opposite the rack, through an orifice having provisions for fixing a printed circuit whose conducting zones are connected, in the desired configuration, to said internal and external terminals.

With this arrangement it is possible, during assembly in the factory, to assign to the micro-switch different functions, without modifying the structure of the apparatus.

11 Claims, 4 Drawing Sheets

FIG.1
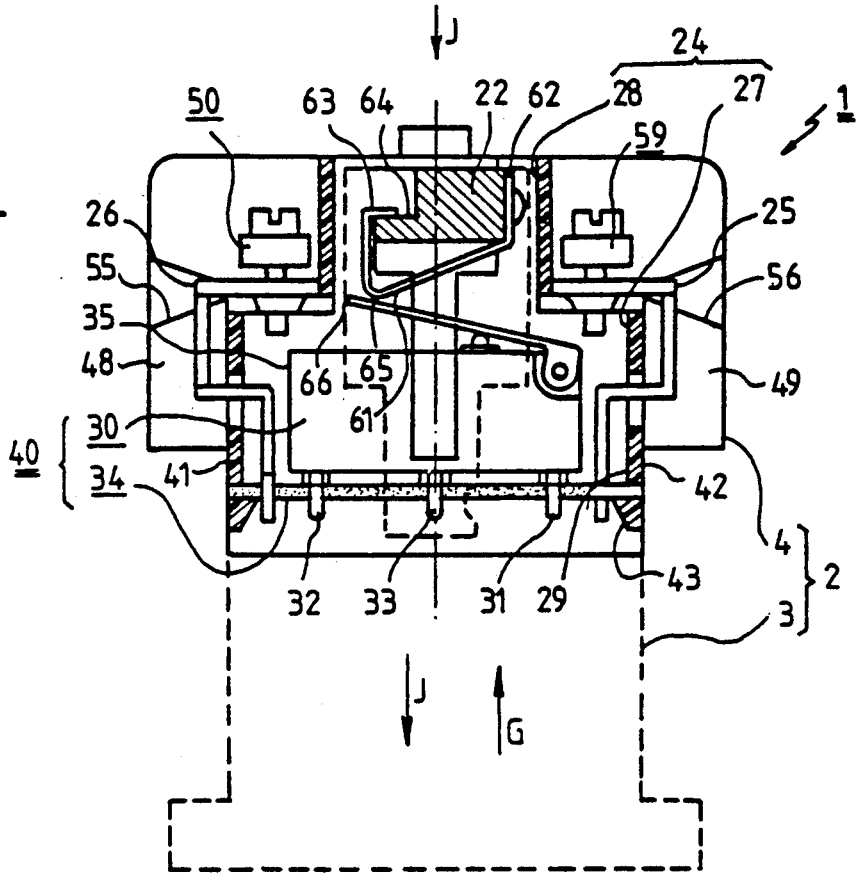
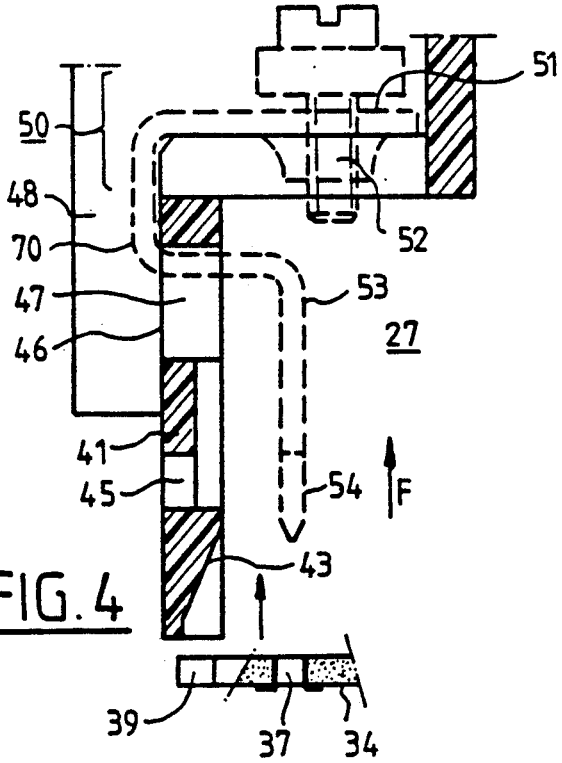
FIG.4
FIG.7
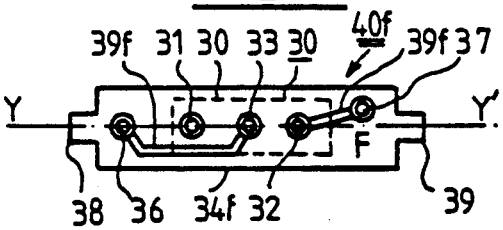
FIG.6
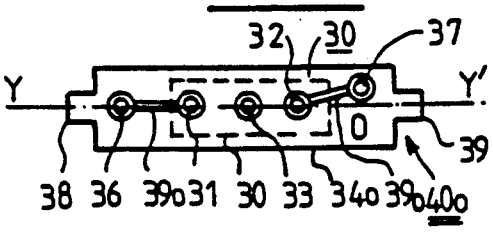

FIG. 2
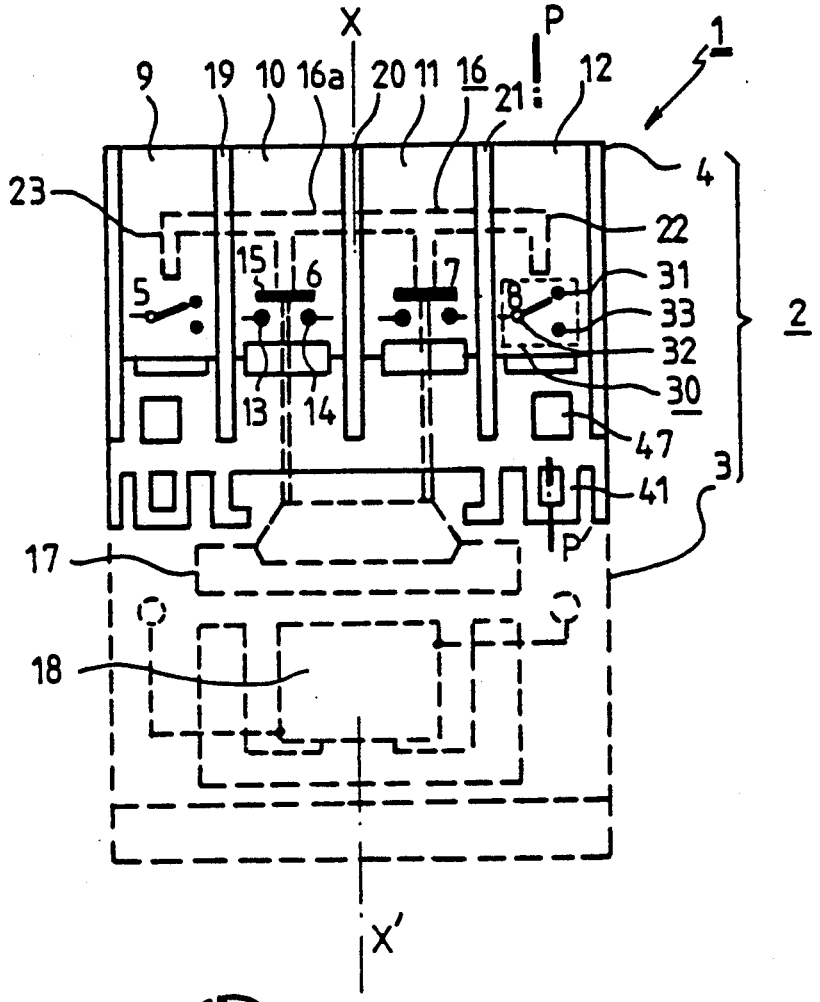
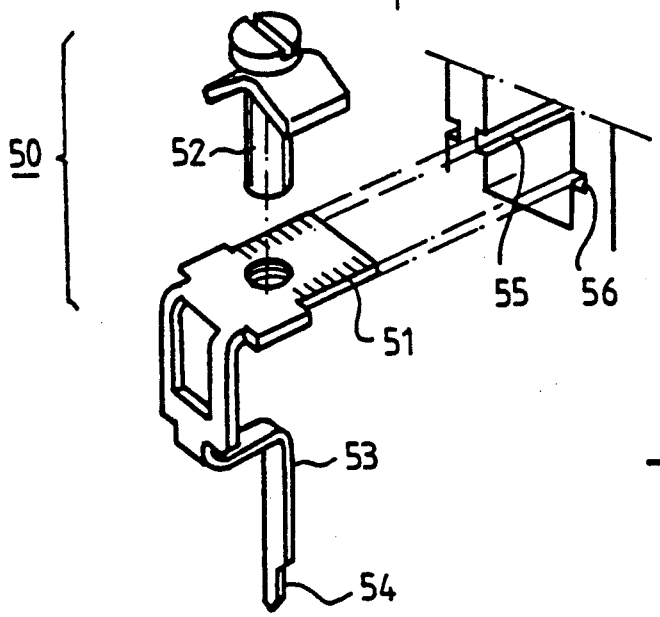
FIG. 5

PROTECTED SWITCH CONTACTOR APPARATUS

BACKGROUND OF THE INVENTION

1. Field of the Invention

The invention relates to a contactor apparatus comprising a body with a plurality of parallel sections with each of which is associated a switch which is placed in a circuit to be controlled and whose mobile contact piece is actuated by the movements of a common rack, at least one of these switches being in the form of a monostable sealed micro-switch with high speed cut-off, whose own internal terminals are connected electrically to two external connecting terminals disposed in each section, these sections being carried by an upper part of this body which is associated with a base.

2. Description of the Prior Art

Such apparatus, mainly used when the reliability of conventional switches may be compromised by the environment, in particular when these switches are to be placed in low level control or monitoring circuits, may be illustrated by patent FR 1 150 455 having a substantially closely related structure.

In the particular presentation of this contactor, it has already been proposed to actuate small switches in sealed cases, commonly called mini- or micro-switches, by means of an electromagnet used generally for actuating low voltage switches.

Difficulties always arise when these small cases are to be fixed in a precise position or for their electric connection to terminals which, so as not to disconcert the assembly personnel, must be in a form identical to that of terminals usually met with in the same apparatus or in adjacent apparatus having higher current ratings, and so comprising power switches.

Furthermore, and to comply with a frequent need of function combination, it is necessary to confer on these small switches either opening functions or closing functions, or else combined functions, the demand for which must be able to be satisfied during assembly in the factory. These functions must not be able to be readily modified during a subsequent action by an inexperienced user.

SUMMARY OF THE INVENTION

According to the invention, the above aim is attained because, between two opposite open housings of a section intended to receive a micro-switch, and adapted for receiving the external connection terminals, there is provided an insulated cavity serving as housing for this micro-switch and opening on a first side in the vicinity of a portion of the rack and on a second opposite side in the vicinity of means for holding it in position, which are adapted for receiving, on the one hand, an insulating support which is provided with conducting portions connected to chosen terminals of the micro-switch which it carries and adapted to establish, on the other hand, an electric connection between each connection terminal and a corresponding conducting portion, these cavities being closed by the base of the apparatus.

BRIEF DESCRIPTION OF THE DRAWINGS

The invention as well as an advantageous embodiment will be better understood from the following description, with reference to the accompanying figures which show:

FIG. 1, a partial sectional view of a contactor apparatus through a plane passing through the axes of the two connection terminals of a circuit controlled by a micro-switch;

FIG. 2, a partial external side view of an apparatus according to FIG. 1, in which the switches are shown diagrammatically;

FIG. 4, a detail view in section of the means used locally for fixing and connecting the device according to the preceding Figure;

FIG. 5, a perspective view of an external connection terminal;

FIGS. 6 and 7, two bottom views of devices according to FIG. 3, having respectively the functions of opening and closing circuits;

DESCRIPTION OF THE PREFERRED EMBODIMENTS

Figure 3:
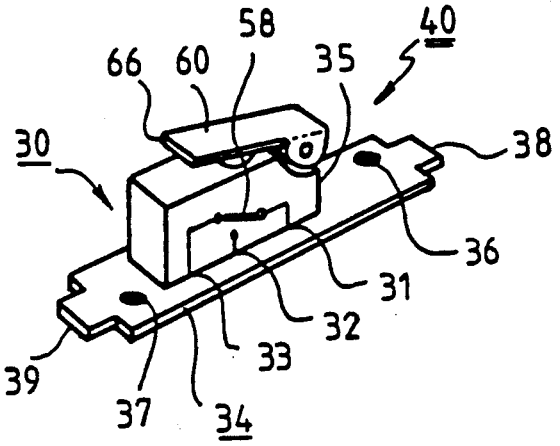
FIG. 3, a perspective view of a micro-switch device associated with a connection support.

A contactor type switching apparatus 1 in accordance with the invention, and as shown in FIG. 1, comprises a case 2 formed for example by the association using means not shown of a base 3 and a cover 4.

As can be seen in FIG. 2, this apparatus is intended to actuate switches such as 5, 6, 7 and 8 situated respectively in one of the insulated sections 9, 10, 11, 12 each assigned to a circuit to be controlled. Among these switches, some of them situated in the vicinity of a central axis XX' and such as 6, 7 are formed from fixed contact pieces 13, 14 fast with the cover and mobile contact pieces such as 15 carried by a rack 16 which is itself associated with a mobile armature 17 of an electromagnet 18 disposed in the base. The other two switches, 5, 8 which are in the form of change-over micro-switches 30 have their own terminals 31, 32, 33. This rack has been shown diagrammatically with a broken line.

Figure 8:
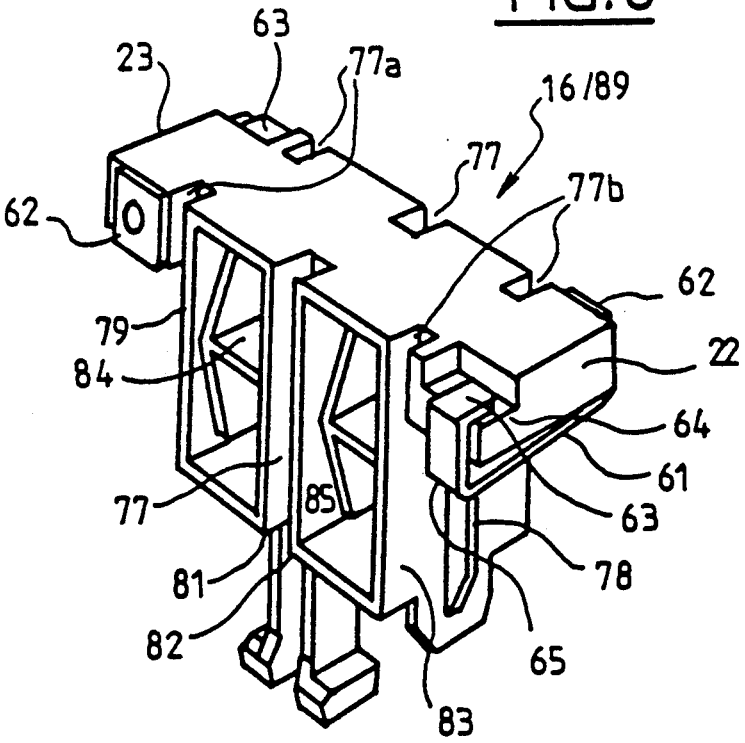
FIG. 8, a perspective view of a control rack used for actuating two micro-switches disposed in a contactor apparatus.

The rack, which is guided in the cover and has grooves for it to straddle the insulating walls such as 19, 20, 21 placed between sections, has two lateral extensions 22 and 23 which penetrate into the opposite lateral sections 9 and 12, whereas a cross-piece **16*a* of the same rack extends through two central adjacent sections 10 and 11, see also FIG. 8**.

As can be best seen in FIG. 1 in which one of these extensions 22 is in section each extension penetrates into a section chamber such as 24 having, between two external connection terminals 25, 26, a cavity 27; this cavity, which is open at its upper part so as to form a clearance 28 in which extension 22 can move, is also open at its lower part 29 and may be closed by the base 3 when the latter is associated with the cover.

As can be seen in FIGS. 3, 6 and 7, case 35 of micro-switch 30 is soldered by its own terminals 31, 32, 33 to a printed circuit board portion 34 of rectangular-shape which has five openings, advantageously metal-coated so as to form a sub-assembly 40 which is ready to be fitted; it can be seen on the one hand that two of these openings 36, 37 placed at the ends are slightly offset with respect to an axis of symmetry YY' of this board and that, on the other hand, the opposite ends of this board have two transverse narrowed portions or tenons 38, 39 whose functions will be explained below.

Referring to FIGS. 2 and 1, it can be noted that opening 29 of cavity 27 opens out in the vicinity of two open tongues 41, 42 which are integrally molded with cover 4. These tongues, whose thicknesses are fairly small so as to confer a certain elasticity thereon, each have a bevelled hook such as 43 flush with a small mortise such as 45, see also FIG. 4.

The sub-assembly 40 is fitted in cavity 27 in the direction of arrow G by bending the tongues until the tenons 38, 39 are engaged in the mortises such as 45. The dimensions of the tenons and of the mortises are sufficiently adjusted so that the sub-assembly is held correctly in position, relatively to the extension of the corresponding rack, and remains in equilibrium substantially in a plane of symmetry PP' of the cavity.

Above each of the mortises such as 45 is provided a wall 46 of the cover which supports tongue 41, a passage 47 causing an externally open volume 48, respectively 49, of a section to communicate with the corresponding cavity 27, see FIG. 4.

These external volumes are intended to receive the external extension terminals such as 50, 59, as can be seen in FIGS. 1 and 4, for connecting the terminals of the micro-switch 30 electrically to the external circuit with which it is associated.

A connection terminal 50, shown in FIG. 5, is in the form of a conducting piece 70 cut out and bent having mainly a contact area 51 with a tapped hole in which is engaged a screw 52 associated with its stirrup piece and an extension 53 which penetrates into cavity 27 so as to come into contact with a conducting track carried by board 34. For this purpose, extension 53 which is bent three times at 90° so as to pass through the passage 47, and be directed perpendicularly to the plane of the board, has a pin 54 of smaller dimensions so as to penetrate into one of the metal-coated openings 37, respectively 36; such penetration is caused by an appropriate movement when, with the terminals previously positioned, the sub-assembly of the micro-switch is engaged in the cavity in direction G and clipped on the hooks 43. To prevent erroneous orientation of the sub-assembly 40, which would not place the end 66 of the control lever 60 facing a bend 65 of a metal piece 61 fast with extension 22, see FIG. 1, in cavity 27, the micro-switch 30 may be advantageously placed closer to one end of board 34 than the other.

Since, for reasons of technical economy, the two terminals 50, 59 are identical, the pins of two extensions are, after turning through 180°, offset with respect to the mean plane PP', which justifies the fact that the metal-coated holes 36, 37 for receiving them are themselves offset with respect to the mean axis of symmetry YY' of the printed circuit board.

After being positioned as mentioned above, the pins such as 54 passing through openings 38, 37 softly soldered to the tracks of board 34, see FIGS. 6 and 7. Because of the bent conformation of the terminal which is further firmly engaged in grooves such as 55, 56 of the adjacent walls, no mechanical stress is imparted to the printed circuit board during tightening of the screw, see FIG. 5, these pins being further sufficiently rigid to guarantee that the switch device is held in position if the hooks happen to yield.

Depending on whether the function assigned to a circuit involves opening -O- or closure -F- thereof, when the electromagnet is energized, for forming the corresponding sub-assembly $40_O$, respectively $40_F$, one of two boards $34_O$-$34_F$ will be used whose conducting tracks $39_O$, $39_F$ connect to the associated connection terminal one of the two corresponding terminals 31, 33 of the micro-switch, see FIGS. 6 and 7. The letters -O- and -F- may advantageously appear on the printed circuit board so as to facilitate identification of the function attributed to a switch sub-assembly $40_O$, respectively $40_F$.

The rocking and resilient control lever 60 which is carried by a pivot of the case of the micro-switch, see FIG. 3, and which faces the clearance 28, is actuated by a metal pusher 61 fast with extension 22. This pusher is formed by a fine resilient blade, one end 62 of which is anchored in this extension, whereas the other end 63 bears resiliently on a heel 64 of extension 22 of the pusher under the effect of a slight previous deformation, see also FIG. 8.

A bend 63 of this blade which is placed opposite the lever communicates to the latter a rotation when the armature is attracted in direction J. With the arrangement described, possible deviation of the rest position of the end 66 of lever 60 may be compensated for, as well as possible overshooting of the travel theoretically attributed to the armature and the rack.

In the embodiment which has just been described, the switches lodged in sealed cases or micro-switches have been placed in the lateral sections 9, 12 of the apparatus so as to facilitate both the provision of a rack 16, common to all the switches and the positioning and electric connection of the sub-assembly 40; the operation of this rack, which can be better understood from FIG. 8, explains additional reasons which have guided the choice of the forms of this rack so as to confer sufficient rigidity thereon while providing excellent guidance for it and conferring thereon complementary insulation functions.

It can in particular be seen that the insulating and guide groove 77 may be engaged on an indentation of the wall 20, whereas the lateral guide rib 78 is engaged in a groove in wall 21; the wall portions such as 79, 83, 81, 82, in cooperation with associated walls, increase the leak lines which is required for the presence in two central chambers 84, 85 of mobile bridges 15 belonging to power switches 6, 7 whose working voltage and currents are substantially higher than those serving the micro-switches. Grooves 77*a* 77*b* have functions comparable to groove 77 but for cavities 27, 28, 24.

The symmetrical arrangement with respect to axis XX' of two switches 6, 7 of a first kind and that of two switches 5, 8 of a second kind provides excellent balancing of the forces which the rack withstands when the electromagnet is energized and consequently contributes to smooth sliding during movement as well as absence of jamming during compression of the springs returning the contacts.

Figure 9:
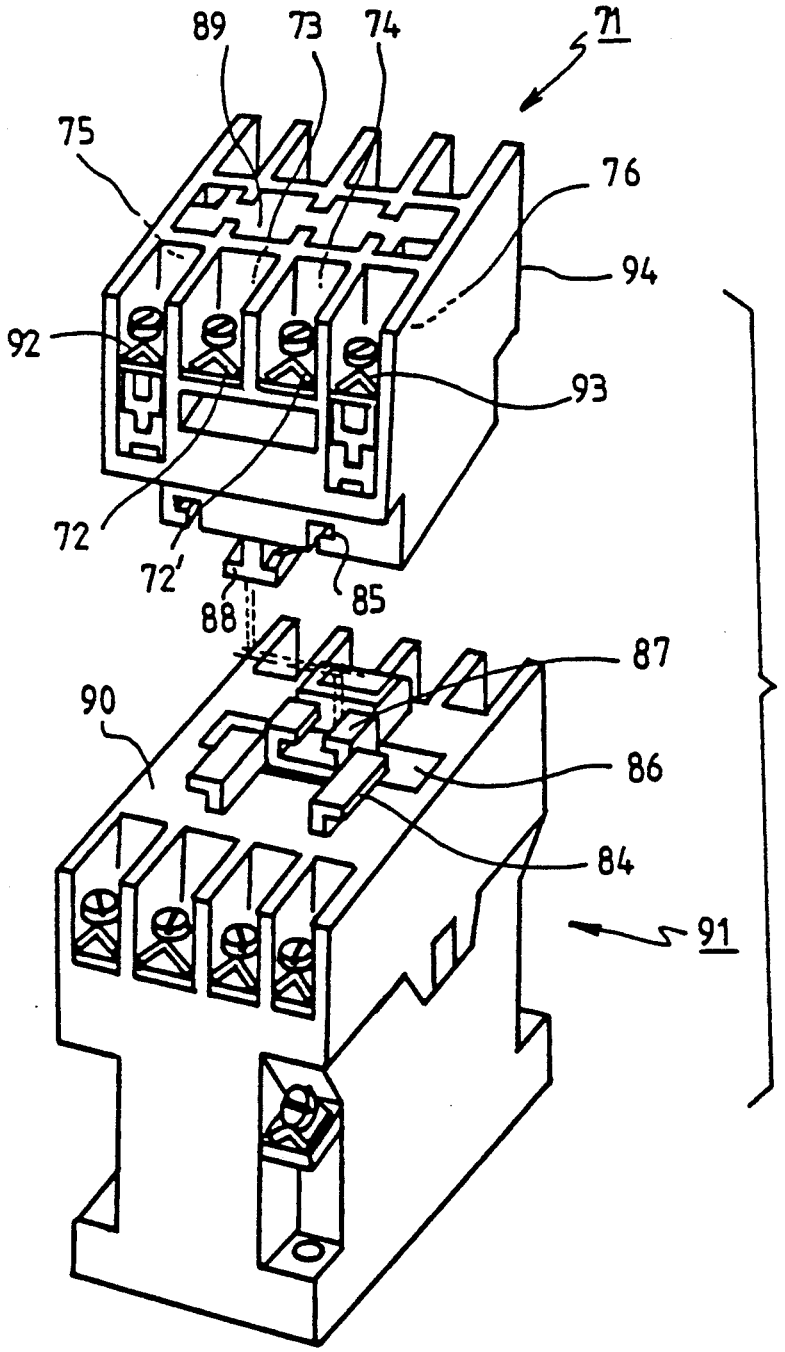
FIG. 9, a perspective view of an auxiliary contact case in accordance with the invention and associated with an independent contactor apparatus.

A cover 4 forming an integral part up to now of body of a contactor apparatus 1 may also be in the form of a case 94 for removable auxiliary contacts 71 having the same construction and which can be associated mechanically with a front face 90 of a conventional contactor apparatus 91, see FIG. 9. Similarly, we find again here central external connection terminals 72, 72' serving the contactor bridge switches or similar 73, 74 and lateral external connection terminals 92, 93 serving sealed case switches 75, 76.

A removable connection between this case and this front face is for example provided by a tenon 84 and mortise 85 system whereas a mobile rack with gripping means 86, 87 of the contactor is then coupled to a hook 88 of the mobile rack 89 associated with case 94, this latter rack being similar to the one described above in connection with FIG. 8.

What is claimed is:

1. A contactor apparatus comprising a body having an upper wall, a lower wall, a front wall, a rear wall and two opposite lateral walls, each comprising a lower part and an upper part which is offset inwardly with respect to the lower part and which is connected to the upper part by means of a transversal portion which extends substantially parallel to the upper wall, said body further comprising two rows of insulating partitions which extend parallel to the front wall from the transversal portion and from the upper parts of the lateral walls, thus forming therebetween a first plurality of cells and a second plurality of cells respectively facing the cells of the first plurality, each cell containing a connecting terminal mounted on a corresponding transversal portion, the lower parts of the lateral walls delimiting an internal volume comprising first and second superimposed chambers partially separated by at least one printed circuit board which is extending parallel to the upper walls, said first chamber containing an electromagnet and said second chamber lodging at least one micro-switch component which is disposed in a zone located between two facing cells, which is mechanically and electrically connected to the printed circuit board and which comprises actuating means oriented towards said upper wall, the upper parts of the lateral walls delimiting with the upper walls a third chamber which communicates with the second chamber and wherein a rack actuated by the electromagnet is mechanically coupled to said actuating means, at least a first terminal of first plurality and a second terminal of the second plurality which is located in front of the first terminal being electrically connected to the printed circuit board.

2. The contactor apparatus as claimed in claim 1, wherein said printed circuit board is fixed inside the body by fixing means which comprise tenons formed on the printed circuit board which cooperate with resilient hooking means formed on the inner faces of the said lateral walls.

3. The contactor apparatus as claimed in claim 2, wherein the said first and second terminals each comprise a conducting piece which comprises a bent portion adjacent to the said transversal portion and an extension which is parallel to the said lateral walls.

4. The contactor apparatus as claimed in claim 3, wherein said extension has an end portion which penetrates into an opening formed in the printed circuit board in the vicinity of said resilient hooking means, and which is welded on a conducting track of the printed circuit board.

5. The contactor apparatus as claimed in claim 1, wherein the micro-switch component is of the monostable change-over type with three terminals.

6. The contactor apparatus as claimed in claim 5, wherein said micro-switch component is placed asymmetrically on the printed circuit board so as to prevent incorrect engagement in the said second chamber.

7. The contactor apparatus as claimed in claim 4, wherein the openings in said printed circuit board are placed asymmetrically with respect to a mean axis YY' thereof, so as to prevent incorrect engagement with the extensions.

8. The contactor apparatus as claimed in claim 1 and in which the micro-switch element has an operating lever, wherein the portion of the rack facing the lever comprises a resiliiently deformable blade for cooperating therewith.

9. The contactor apparatus as claimed in claim 1, wherein two opposite end portions of the rack actuate two micro-switch devices, whereas a central region of this rack receives mobile contact bridges forming part of switches placed in circuits through which higher currents flow.

10. The contactor apparatus as claimed in claim 1, wherein this apparatus comprises two parts removably assembled to each other, i.e. a first part including the first chamber and a second part including the second and third chambers.

11. The contactor apparatus as claimed in claim 10, wherein the first part is formed by a contactor apparatus and the second part consists of a removable sub-assembly including at least said micro-switch element and said rack, disconnectable coupling means being provided between said rack and a mobile armature of said contactor.

* * * * *